US006348017B1

(12) United States Patent
Yates

(10) Patent No.: US 6,348,017 B1
(45) Date of Patent: Feb. 19, 2002

(54) APPARATUS FOR PLACING AND RETRIEVING GOLF BALLS AND TEES

(76) Inventor: Patrick D. Yates, 21417 Brewer Rd., Grass Valley, CA (US) 95949

( * ) Notice: Subject to any disclaimer, the term of this patent is extended or adjusted under 35 U.S.C. 154(b) by 0 days.

(21) Appl. No.: 09/666,887

(22) Filed: Sep. 20, 2000

(51) Int. Cl.[7] ..... A63B 57/00

(52) U.S. Cl. ..... 473/386; 473/284; 473/286; 294/19.2

(58) Field of Search ..... 473/284, 286, 473/386; 294/19.1, 19.2

(56) References Cited

U.S. PATENT DOCUMENTS 2,623,769 A * 12/1952 Kegley, Sr. ..... 294/19.2
4,313,604 A * 2/1982 Baxter ..... 473/386
5,102,139 A * 4/1992 Greig ..... 473/286
5,540,432 A * 7/1996 Keller ..... 473/386
6,257,635 B1 * 7/2001 Torelli ..... 293/19.2

* cited by examiner

*Primary Examiner*—Steven Wong
(74) *Attorney, Agent, or Firm*—Thomas R. Lampe

(57) ABSTRACT

Apparatus for placing and retrieving golf balls and tees includes a support block forming a recess to receive a tee top. Attached to converging surfaces of the support block are a tee impact plate used to pound a tee into the ground and a golf ball retainer including two arms having spaced ends and defining a recess for holding and carrying a golf ball. In addition, the support block supports a tubular-shaped retainer having an outwardly flared flange at one end thereof, the pick-up member being used to pick-up tees and the flange also serving to retain a golf ball in position between the arms of the golf ball retainer.

12 Claims, 3 Drawing Sheets

APPARATUS FOR PLACING AND RETRIEVING GOLF BALLS AND TEES

TECHNICAL FIELD

This invention relates to apparatus for use by a golfer that is operable to both place and retrieve golf balls and tees. The invention is suitable for use by physically challenged golfers as well as golfers in general.

BACKGROUND OF THE INVENTION

Placing and retrieving golf balls and tees by wheelchair bound or other physically challenged golfers can be a problem. Quite simply, it is difficult, and in some cases impossible, for an individual seated in a wheelchair to set the tee, tee-up the ball on the tee, retrieve the tee after hitting the ball down the fairway and retrieve the golf ball itself from the ground or from a cup. Even an able bodied golfer will appreciate not having to constantly bend over to perform these various tasks.

DISCLOSURE OF INVENTION

The present invention relates to apparatus which is of inexpensive, relatively simple construction and which allows a golfer to efficiently and effectively perform tasks relating to golf ball and tee retrieval and placement even from a sitting position. The apparatus is quite compact and can readily be inserted and carried in a golf club bag. Further, only very simple and straight forward manipulations of the apparatus are required to perform the various tasks.

The apparatus of the present invention is for placing and retrieving golf balls and tees. The apparatus is of unitary construction and includes a support block having a front block end and a rear block end and opposed sides.

The support block includes a plurality of interconnected block outer surfaces including a substantially planar first block outer surface and a substantially planar second block outer surface. The first block outer surface and the second block outer surface define an angle therebetween and converge at the front block end.

The support block defines a recess extending inwardly from at least one of the opposed sides for receiving the top end of a tee. The support block also defines an opening in the first block outer surface communicating with the recess for accommodating the body of a tee when the top end of the tee is in the recess.

A tee impact plate is mounted on the second block outer surface for pounding a tee into the ground. The apparatus also incorporates a golf ball retainer including a pair of golf ball pick-up and retention arms attached to the support block and extending from the support block and projecting outwardly away from one of the sides of the support block.

The arms define a recess for receiving a golf ball and the arms are positioned from one another a distance less than a diameter of a golf ball.

An elongated handle is attached to the support block and extends in a direction away from the rear block end.

Other features, advantages, and objects of the present invention will become apparent with reference to the following description and accompanying drawings.

BEST MODE FOR CARRYING OUT THE INVENTION

Figure 1:
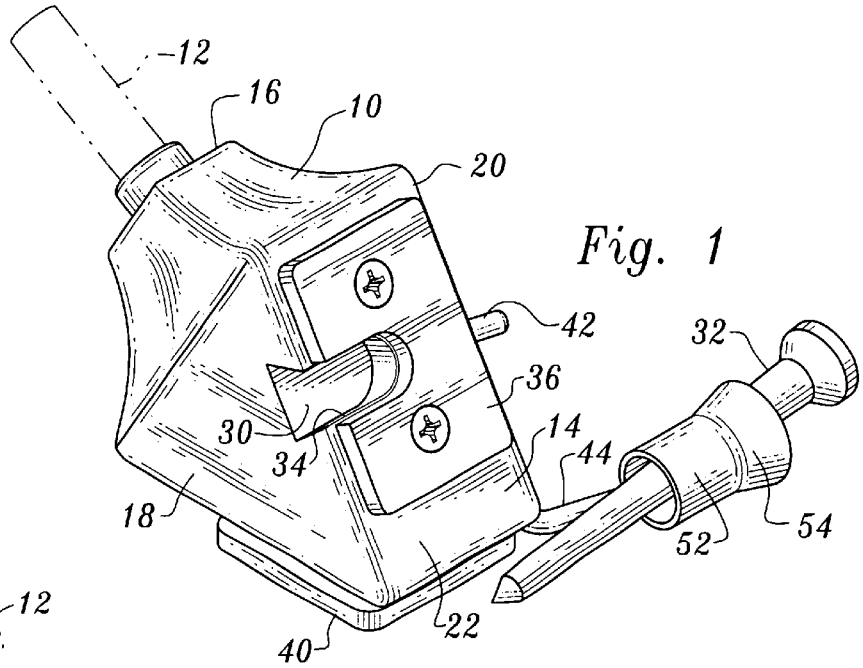
FIG. 1 is a perspective view of apparatus constructed in accordance with the teachings of the present invention and illustrating a tee retained by a tee pick-up member incorporated in the apparatus.
Figure 2:
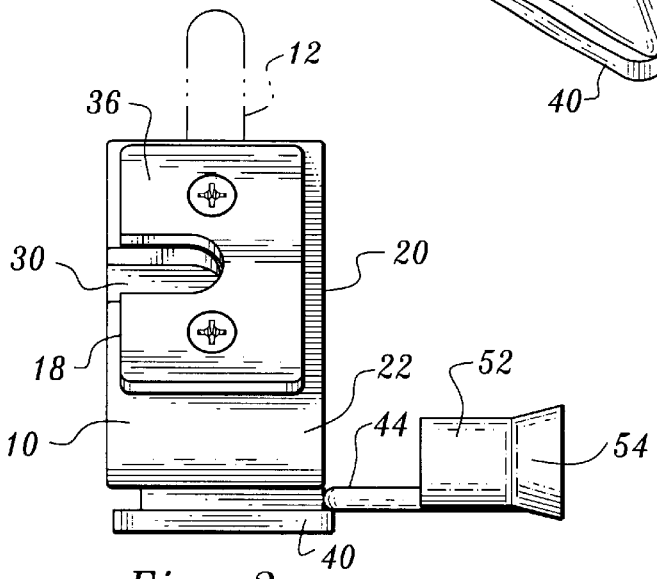
FIG. 2 is a front elevational view of the apparatus without the tee.
Figure 3:
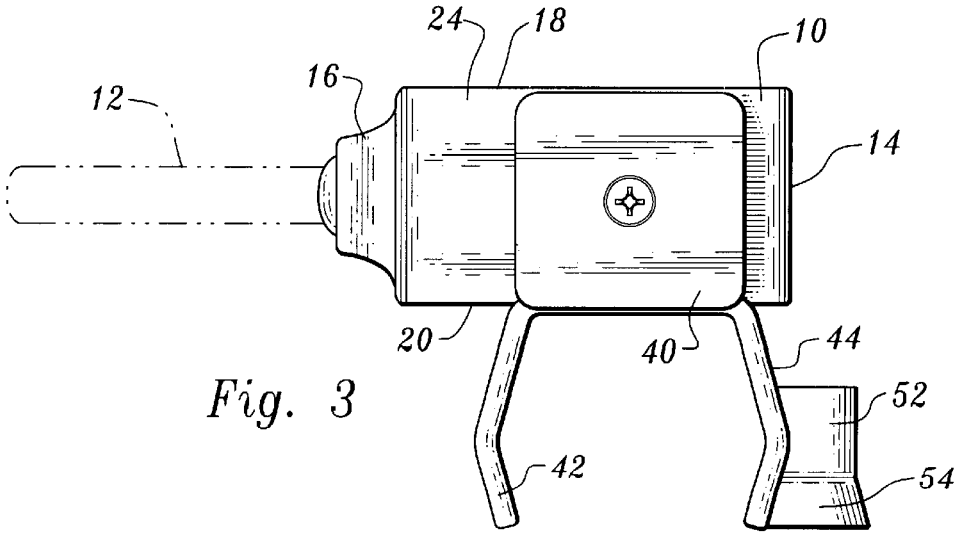
FIG. 3 is a bottom view of the apparatus.

Referring now to the drawings, apparatus constructed in accordance with the teachings of the present invention includes a support block 10 to which a handle in the form of a golf club shaft 12 is attached. Support block 10 may be formed of any suitable material such as wood or metal or plastic.

The support block has a front block end 14 and a rear block end 16 as well as opposed sides 18, 20.

The support block 10 includes a plurality of block outer surfaces including a planar block outer surface 22 and a planar block outer surface 24. The block outer surfaces 22, 24 define an angle therebetween in the order of forty five degrees and converge at the front block end 14 to form a point at the front block end. The handle 18 projects from the rear block end 16 and the primary axis thereof bisects the angle defined by block outer surface 22 and block outer surface 24.

The support block 10 defines a recess 30 extending inwardly from block side 18. As can be seen with reference to FIG. 4, the recess 30 is for the purpose of receiving the top end of a tee 32, the tee being slid into the recess manually from side 18. The support block forms a slot 34 communicating with recess 30, the slot 34 receiving the body portion of the tee and the recess holding the top or enlarged end of the tee. A reinforcement plate 36 is attached to block outer surface 22 by screws and has an indent formed therein so that the reinforcement plate partially surrounds the slot 34.

A tee impact plate 40, preferably formed of steel or the like, is affixed by a screw to the outer surface 24 of the support block.

Secured between tee impact plate 40 and the support block 10 is a golf ball retainer including a pair of golf ball pick-up and retention arms 42, 44. The arms 42, 44 have an angular bend formed therein and have free distal ends spaced from one another. The arms project outwardly away from side 20 of block 10 and define a recess for receiving a golf ball 50 (see FIG. 8), it being understood that the arms are positioned from one another a distance less than the diameter of the golf ball.

Affixed to arm 44 and extending therealong is a tee pick-up member 52, the arm 44 and tee pick-up member being supported by the support block 10.

The pick-up member 52 is a tubular member having spaced open ends. The tubular pick-up member 52 extends laterally relative to support block side 20. A flange 54 in the form of a truncated cone extends outwardly from the open end of the pick-up member 52 furthest from the support block. The flange diverges in a direction away from the support block.

Having described the structure of the invention, operation thereof will now be set forth.

Figure 4:
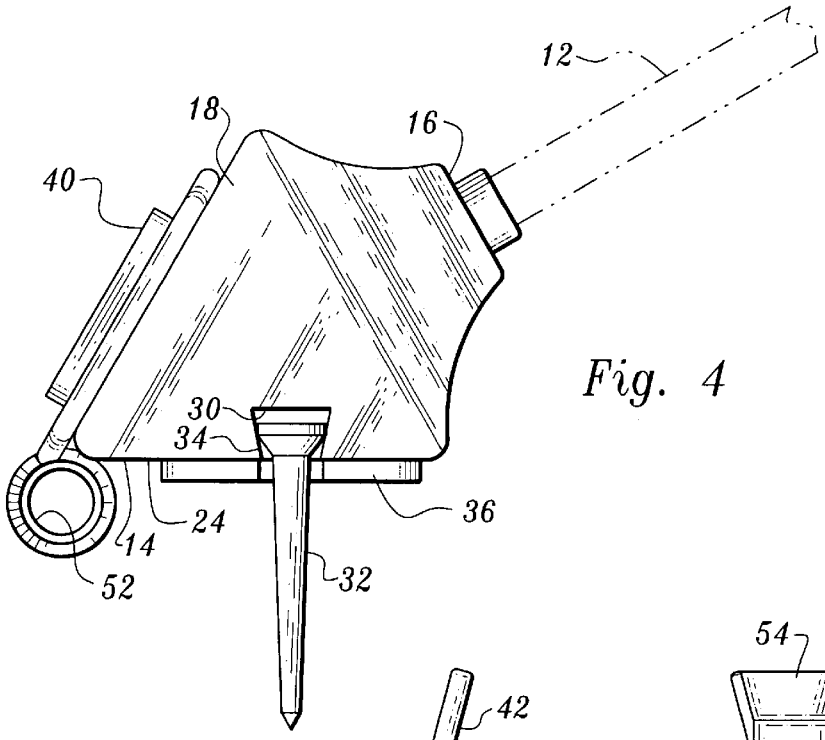
FIG. 4 is a side elevational view of the apparatus illustrating a tee held in position in a recess formed in the apparatus support block.
Figure 5:
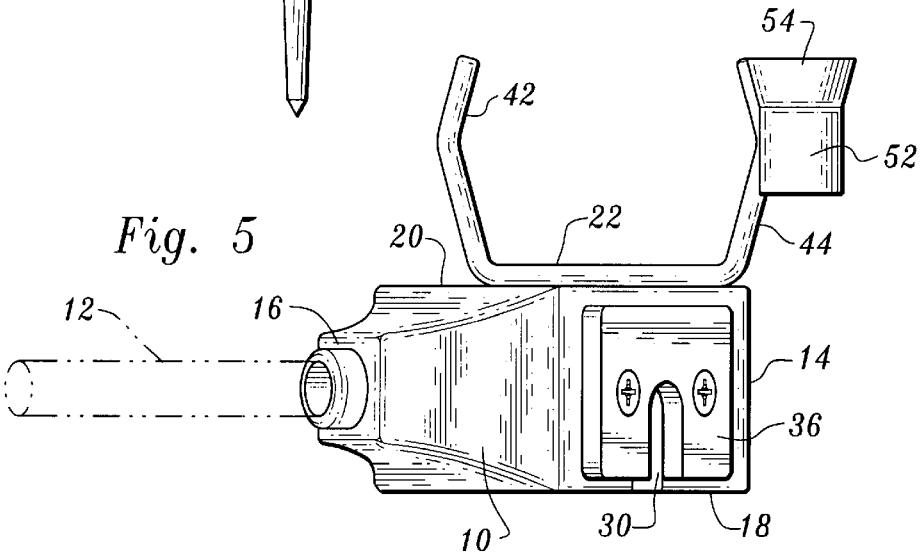
FIG. 5 is a top plan view of the apparatus.
Figure 6:
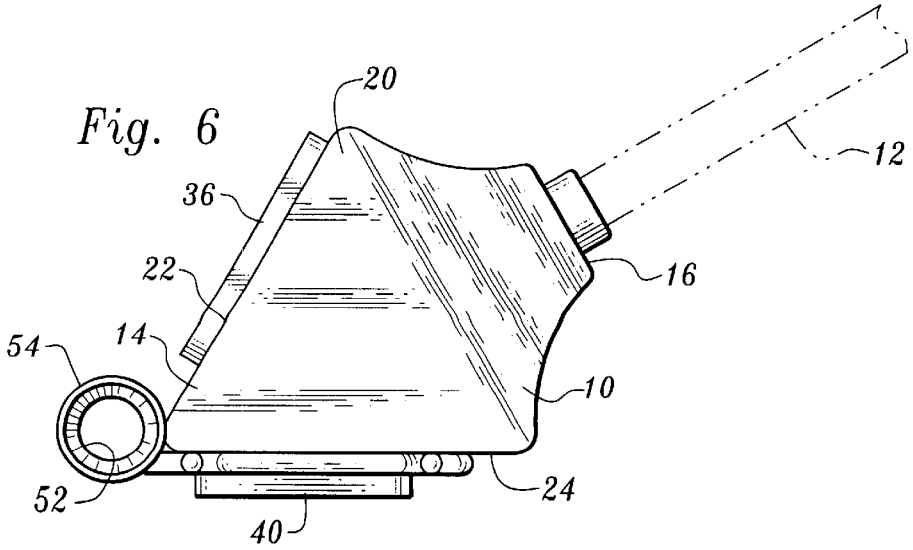
FIG. 6 is a side elevational view of the apparatus taken from the side 180 degrees from that depicted in FIG. 4.

A golfer wishing to set a tee in the ground slides the tee head or top into recess 30 of the support block 10 as shown in FIG. 4. The golfer then uses the handle 12 to drive the pointed end of the tee into the ground employing a downward motion. The tee is released by sliding the block sideways so that the tee exits the recess from block side 18.

Figure 7:
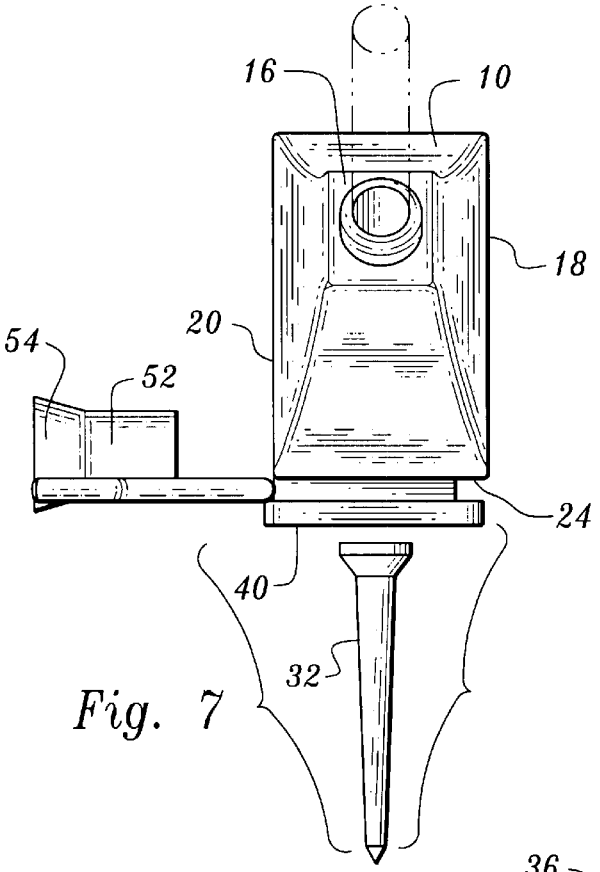
FIG. 7 is a rear elevational view of the apparatus illustrating the position assumed by the apparatus relative to a tee when utilized to pound the tee into the ground.

The handle is then used to invert the support block and the tee impact plate 40 is positioned over the tee as shown in FIG. 7 and used to hammer the tee a desired distance into the ground.

Figure 8:
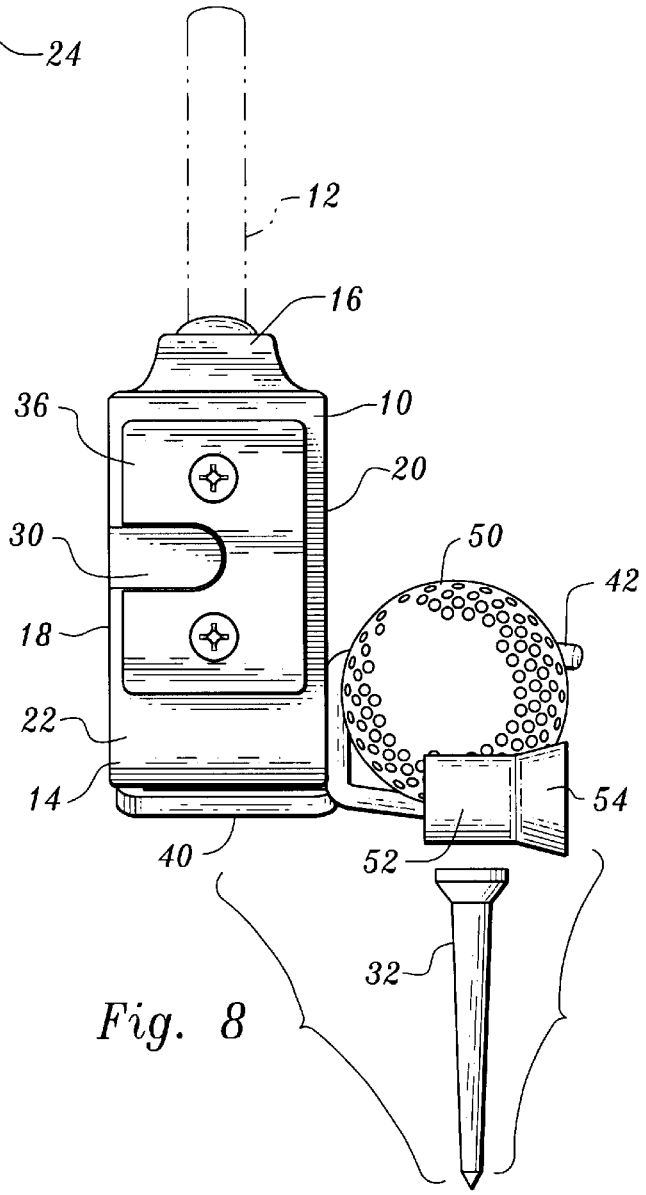
FIG. 8 is an elevational view taken in the direction of arrows 8—8 in FIG. 4 showing the apparatus holding a golf ball and positioned just prior to placement of the golf ball on the top of a tee.

Next, the user places the golf ball 50 on arms 42, 44 as shown in FIG. 8 so that the golf ball is disposed in the recess defined by the arms. Engagement between the golf ball and the flange 54 will resist movement of the golf ball out of the recess. To position the golf ball 50 on tee 32 the golf ball is simply placed thereon by the apparatus and the arms 42, 44 are moved downwardly alongside the tee until there is disengagement of the golf ball from the apparatus; at which time the user simply moves the apparatus laterally away from the golf ball and tee.

After the golf ball is hit by a club, if the tee remains upright the golfer can simply manipulate the apparatus to position the tee back into recess 30 and pull the tee up and out of the ground. If the tee is laying on the grass, the apparatus is maneuvered so that the pointed end of the tee enters flange 54 and tee pick-up member 52 (as shown in FIG. 1), and the tee is scooped up.

The apparatus can also be employed to remove a golf ball from the cup. This is accomplished merely by inserting the arms 42, 44 in the cup under the ball and scooping it up.

The invention claimed is:

1. Apparatus for placing and retrieving golf balls and tees, said apparatus being of unitary construction and comprising, in combination:

a support block having a front block end and a rear block end and opposed sides, said support block including a plurality of block outer surfaces including a substantially planar first block outer surface and a substantially planar second block outer surface, said first block outer surface and said second block outer surface defining an angle therebetween and converging at said front block end, said support block defining a recess extending inwardly from at least one of said opposed sides for receiving the top end of a tee, and an opening in said first block outer surface communicating with said recess for accommodating the body of a tee when the top end of the tee is in said recess, a tee impact plate mounted on the second block outer surface for pounding a tee into the ground, a golf ball retainer including a pair of golf ball pick-up and retention arms attached to said support block extending from said support block and projecting outwardly away from one of the opposed sides, said golf ball pick-up and retention arms defining a recess for receiving a golf ball and being positioned away from one another a distance less than the diameter of a golf ball, and an elongated handle attached to said support block and extending in a direction away from the rear block end.

2. The apparatus according to claim 1 wherein a portion of said golf ball retainer is secured between said tee impact plate and said support block.

3. The apparatus according to claim 1 additionally comprising a tee pick-up member supported by said support block, said tee pick-up member defining a pick-up member opening for receiving a tee and for retaining the tee after pick-up thereof.

4. The apparatus according to claim 3 wherein said tee pick-up member comprises a tubular member having spaced open ends.

5. The apparatus according to claim 4 wherein said tubular member is connected to one of said golf ball pick-up and retention arms and extends laterally relative to one of the sides of said support block and is spaced from said support block.

6. The apparatus according to claim 5 wherein a projection is formed on said tubular member adjacent to the open end thereof furthest from said support block, said projection engageable by a golf ball received in said recess to resist movement of the golf ball out of said recess.

7. The apparatus according to claim 6 wherein said projection comprises a flange in the form of a truncated cone extending outwardly from the open end of said tubular member furthest from said support block, said flange diverging in the direction away from said support block.

8. The apparatus according to claim 1 wherein said opening comprises a slot, said apparatus additionally comprising a reinforcement plate attached to said support block and partially surrounding said slot.

9. The apparatus according to claim 1 wherein said first block outer surface and said second block outer surface form a point at said front block end.

10. The apparatus according to claim 1 wherein said support block is formed of wood and wherein said tee impact plate is formed of metal.

11. The apparatus according to claim 1 wherein said first block outer surface and said second block outer surface define an angle of about forty-five degrees therebetween.

12. The apparatus according to claim 1 wherein said handle extends from the rear block end along a line substantially bisecting the angle defined by said first block outer surface and said second block outer surface.

* * * * *